US005533816A

United States Patent [19]

Ikeda et al.

[11] Patent Number: 5,533,816

[45] Date of Patent: Jul. 9, 1996

[54] THERMAL RECORDING METHOD AND RECORDING APPARATUS USING THE SAME

[75] Inventors: Keiichi Ikeda, Yokohama; Yoshiyuki Mizoguchi, Kawasaki, both of Japan

[73] Assignee: Canon Kabushiki Kaisha, Tokyo, Japan

[21] Appl. No.: 247,396

[22] Filed: May 23, 1994

Related U.S. Application Data

[63] Continuation of Ser. No. 65,034, May 24, 1993, abandoned, which is a continuation of Ser. No. 899,941, Jun. 17, 1992, abandoned, which is a continuation of Ser. No. 456,484, Dec. 26, 1989, abandoned.

[30] Foreign Application Priority Data

Dec. 23, 1988 [JP] Japan ..... 63-323681
Dec. 21, 1989 [JP] Japan ..... 1-329571

[51] Int. Cl.[6] ..... B41J 2/36

[52] U.S. Cl. ..... 400/120.07; 400/120.01; 347/183

[58] Field of Search ..... 400/120, 120.01, 400/120.05, 120.06, 120.07, 120.09; 346/76 PM

[56] References Cited

U.S. PATENT DOCUMENTS

| | | | |
|---|---|---|---|
| 4,510,507 | 4/1985 | Ishikawa | 346/76 PH |
| 4,686,579 | 8/1987 | Sakamoto | 358/282 |
| 4,701,808 | 10/1987 | Nagashima | 358/287 |
| 4,806,949 | 2/1989 | Onuma et al. | 358/298 |
| 4,806,950 | 2/1989 | Sekine | 358/248 |
| 4,951,152 | 8/1990 | Suzuki | 400/120 |

FOREIGN PATENT DOCUMENTS

| | | | |
|---|---|---|---|
| 57-57682 | 4/1982 | Japan | 400/120 |
| 199660 | 8/1988 | Japan | 400/120 MT |

*Primary Examiner*—Ren Yan
*Assistant Examiner*—Steven S. Kelley
*Attorney, Agent, or Firm*—Fitzpatrick, Cella, Harper & Scinto

[57] ABSTRACT

In a thermal recording method of recording an image on a recording medium and a thermal recording apparatus using this thermal recording method, image data is divided into blocks in units of a plurality of bits to convert the blocks into recording head drive data, and a pulse width of a strobe signal corresponding to each bit of the converted drive data and a count of drive data arrays applied to a head are controlled to perform halftone image recording.

33 Claims, 4 Drawing Sheets

THERMAL RECORDING METHOD AND RECORDING APPARATUS USING THE SAME

This application is a continuation of application Ser. No. 08/065,034 filed May 24, 1993 now abandoned, which is a continuation of application Ser. No. 07/899,941 filed Jun. 17, 1992 now abandoned, which is a continuation of application Ser. No. 07/456,484 filed Dec. 26, 1989 now abandoned.

BACKGROUND OF THE INVENTION

1. Field of the Invention

The present invention relates to a thermal recording method for recording an image on a recording medium (e.g. , normal paper, thermal paper, processed paper, or an OHP sheet) by using heat and a recording apparatus using this thermal recording method and, more particularly, a thermal recording method capable of recording a halftone image on the recording medium and a recording apparatus using this thermal recording method.

The recording apparatuses include an electronic typewriter, a copying machine, a facsimile machine, and a printer. The recording methods include (A) the so-called ink-jet method, i.e., a method of applying heat to change a state of a recording liquid, and injecting the recording liquid from an injection port on the basis of the change in state to form an ejection droplet, thereby recording an image on a recording medium, (B) the so-called thermal printing method, i.e., a method of causing color development of thermal paper to perform recording, and (C) the so-called thermal transfer method, i.e., a method of transferring an ink of an ink ribbon to a recording medium by heating, thereby performing recording.

2. Related Background Art

In a multi-harmonization or a multi-gradation thermal transfer recording apparatus capable of recording a halftone image by a multi-gradation thermal transfer recording method (e.g., a printer apparatus for performing printing with a thermal head), a printing density is controlled by energy supplied to the thermal head, i.e., by a head voltage level or its energization time.

In a conventional multi-gradation thermal transfer recording method, however, when N-level printing is to be performed, data corresponding to the number of heat generating members of the head, e.g., 512 data, must be transferred or transported N times. For example, if image data is 6-bit data, this data is transferred 64 times. If image data is 8-bit data, this data must be transferred 256 times, which is four times the transfer cycle count of the 6-bit data. For this reason, the printing time has minimum limitations, and it is therefore difficult to shorten the printing time beyond this minimum.

When a highly precise image is recorded, the number of bits of image data is increased. The number of parallel/serial converters for converting image data into head drive data is increased in addition to an increase in recording time, thus complicating a circuit arrangement for generating signals input to the thermal head.

In order to shorten the recording time, a method disclosed in Japanese Patent Laid-Open (Kokai) No. 57-57682 (published on Apr. 6, 1982 in Japan) is known to those skilled in the art. According to the basic principle of this method, image gradation data is transferred bit by bit. The number of data transfer cycles can be reduced, and the data transfer time can be shortened accordingly. However, energization of heat generating members is not continuous. Even if the heat generating members are energized within an energization time corresponding to the number of gradation levels, data having a high gradation level may result in a lower printing density than data having a low gradation level because of heat dissipation of heat generating members in the time interval during which they are not energized.

SUMMARY OF THE INVENTION

It is an object of the present invention to provide a thermal recording method capable of producing a clear recorded image and a recording apparatus using this thermal recording method.

It is another object of the present invention to provide a thermal recording method capable of improving image quality and a recording apparatus using this thermal recording method.

It is still another object of the present invention to provide a thermal recording method capable of performing good halftone image recording and a recording apparatus using this thermal recording method.

It is still another object of the present invention to provide a thermal recording method capable of performing image recording at a higher speed and a recording apparatus using this thermal recording method.

It is still another object of the present invention to solve the conventional problems described above and to provide a thermal recording method capable of preventing reversal of recording densities from high to low levels of vice versa during recording, and capable of performing good halftone image recording, and a recording apparatus using this thermal recording method.

DETAILED DESCRIPTION OF THE PREFERRED EMBODIMENT

An embodiment to be described below exemplifies a thermal recording method of recording an image on a recording medium, wherein image data is converted into drive data which continuously drives a recording head upon repeated applications of a small number of serial data strings, the converted drive data is bit-sliced, and the recording head is driven in units of bits. When a strobe signal corresponding to each bit of the converted drive data is to be applied to the recording head, the pulse width of the strobe signal applied to the recording head and the count of the serial data strings applied to the recording head are controlled to perform halftone recording.

In addition, in the embodiment to be described below, image data is divided into two blocks at an intermediate bit position, parallel/serial conversion is performed in units of blocks, and the serial data strings of the two blocks are set to be continuous.

The embodiment of the present invention will be described in detail below with reference to the accompanying drawings.

Figure 1:
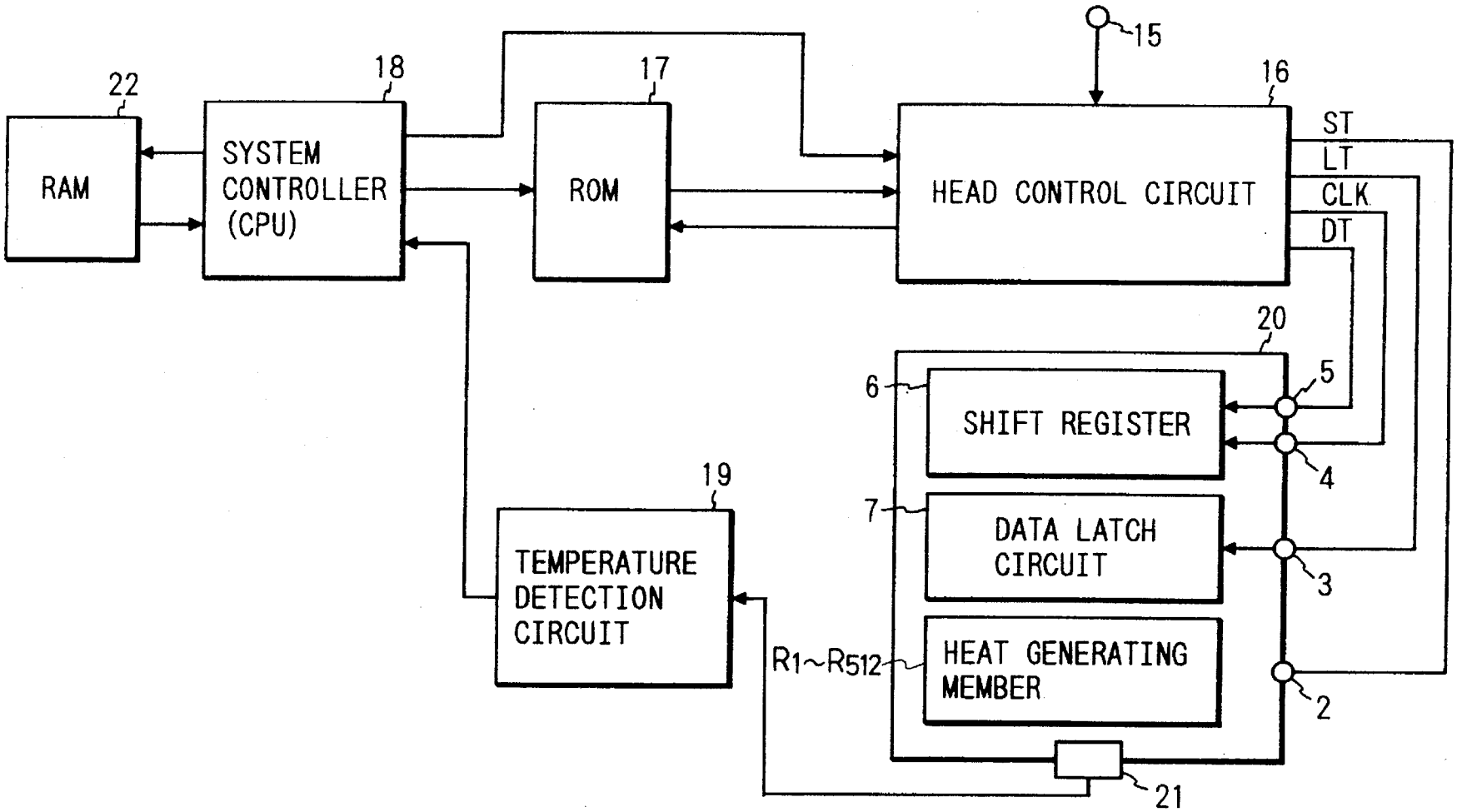
FIG. 1 is a block diagram showing a multi-gradation thermal transfer apparatus according to an embodiment of the present invention.

FIG. 1 shows the embodiment of the present invention.

Referring to FIG. 1, a ROM 17 stores a table for converting 6-bit image data into 14-bit head drive data. The table is exemplified by Table 1. Image data is divided into two blocks at a position between the 3rd bit and the 4th bit so as to obtain continuous "1"s of the bit train. Each block is parallel-serial converted, and the "1"s are concentrated on the center of the bit train. The head drive data of Table 1 is shown as two 7-bit arrays, each of which has an upper bit on the left and a lower bit on the right. A head control circuit 16 converts digital image data into head drive data on the basis of the table stored in the ROM 17 and controls driving of heat generating members on the basis of the converted head drive data. Note that image data is A/D converted data of a video signal and is supplied to the head control circuit 16 from a line memory (not shown) through a terminal 15. A thermistor 21 and a temperature detection circuit 19 cooperate to detect a temperature of a thermal head 20. A system controller (CPU) 18 controls the head control circuit 16 and the ROM 17 on the basis of the temperature detected by the temperature detection circuit 19. A RAM 22 is used as a working area of the system controller 18 and a buffer area for temporarily storing data. The structure of the thermal head 20 is shown in FIG. 2.

Figure 2:
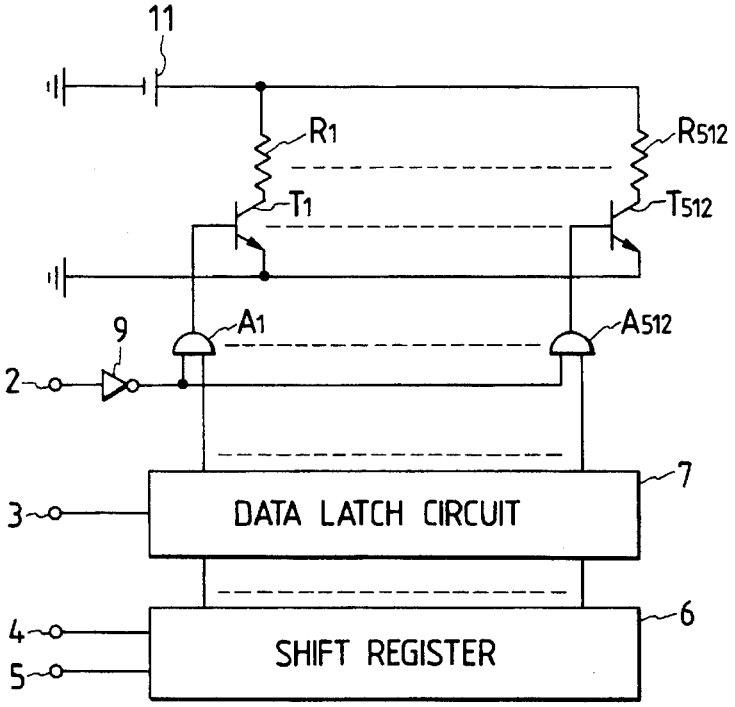
FIG. 2 is a block diagram showing an arrangement of a thermal head 20 shown in FIG. 1.

Referring to FIG. 2, a shift register 6 converts serial data DA input through a terminal 5 into parallel data in synchronism with a clock signal CLK input through a terminal 4. A data latch circuit 7 latches the parallel signal from the shift register 6 in synchronism with a latch signal LT input through a terminal 3. AND gates $A_1$ to $A_{512}$ output the data signal from the data latch circuit 7 during periods corresponding to the pulse width of a strobe signal ST input through an inverter 9. Transistors $T_1$ to $T_{512}$ drive heat generating members $R_1$ to $R_{512}$ in accordance with pulses from the AND gates $A_1$ to $A_{512}$, respectively.

As described above, the image data is A/D converted data of a video signal and is input from a line memory (not shown) to the head control circuit 16 through the terminal 15.

TABLE 1

Table for Converting Image Data into Head Drive Data

| Image Data | Head Drive Data |
|---|---|
| 000000 (0) | 0000000 0000000 |
| 000001 (1) | 0000000 1000000 |
| 000010 (2) | 0000000 1100000 |
| . | . |
| . | . |
| . | . |
| 000111 (7) | 0000000 1111111 |
| 001000 (8) | 0000001 0000000 |
| 001001 (9) | 0000001 1000000 |
| 001010 (10) | 0000001 1100000 |
| . | . |
| . | . |

TABLE 1-continued

Table for Converting Image Data into Head Drive Data

| Image Data | Head Drive Data |
|---|---|
| . | . |
| 111111 (63) | 1111111 1111111 |

Figure 3:
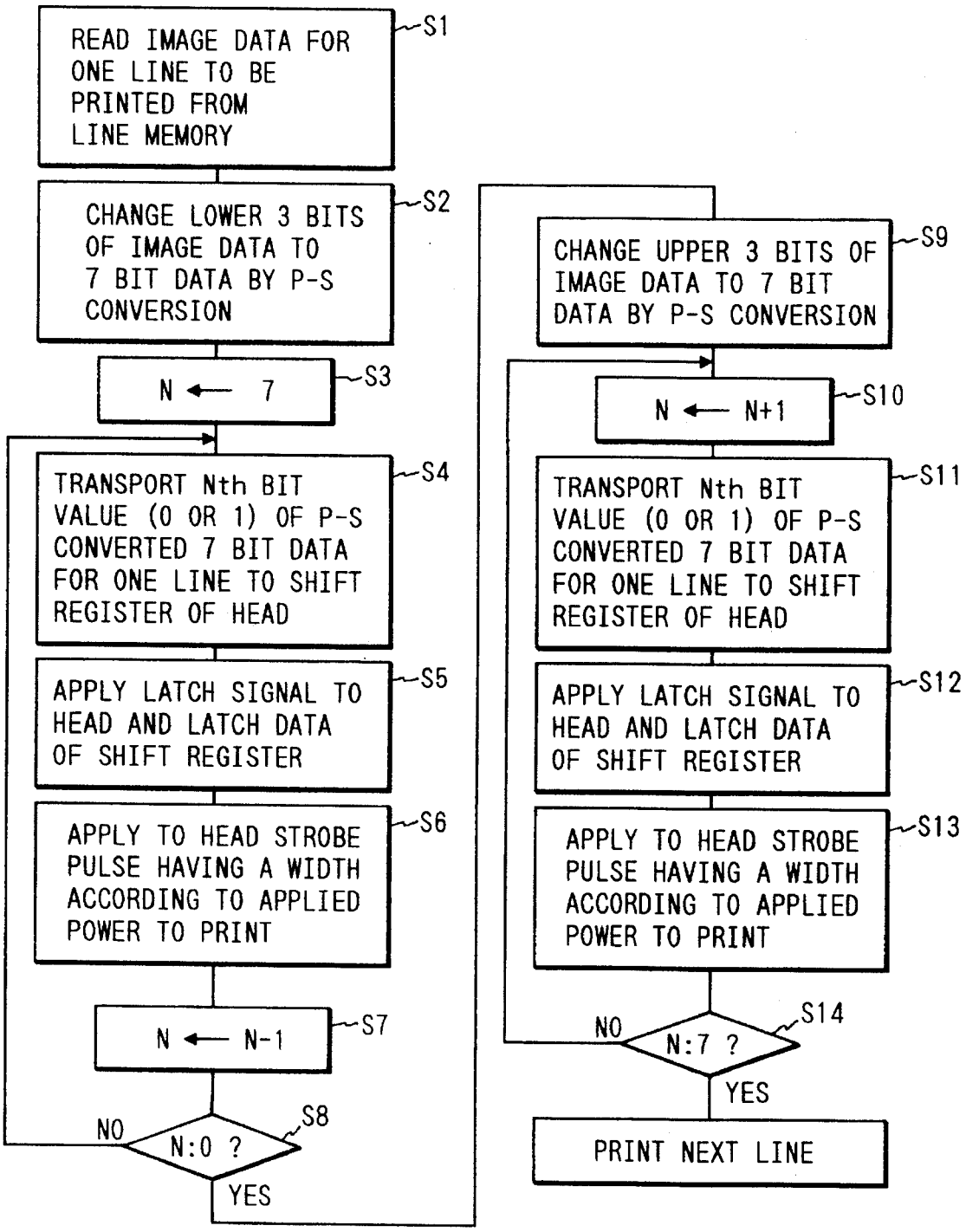
FIG. 3 is a flow chart showing a control sequence of a system controller 18.

FIG. 3 is a flow chart of a control sequence of the system controller.

The thermal head 20 is preheated to increase the temperatures of the heat generating members $R_1$ to $R_{512}$ of the thermal head 20 to a color development temperature of an ink sheet (for thermal transfer recording) or a thermal sheet (for thermal recording).

More specifically, dummy data "1" as data DA1 is transported or transferred from the head control circuit 16 to the data input terminal 5 of the thermal head 20. The 512-bit data DA1 is written in the shift register 6 in synchronism with a clock CLK1. After the data DA1 is written in the shift register 6, a latch signal LT1 is input to the input terminal 3 of the thermal head 20, and "1"s are written in all of 512 bits of the latch circuit 7. A strobe pulse ST1 having a pulse width enough to increase the temperatures of the heat generating members $R_1$ to $R_{512}$ to a color development temperature is applied to an input terminal 2 of the thermal head 20, thereby performing preheating.

After preheating is completed, image data for one line to be printed is read from a line memory in step S1. In step S2, the lower 3 bits of the image data are parallel/serial converted (to be referred to as P-S conversion hereinafter) to obtain 7-bit data. The value "0" of bit 0 as the LSB of the 7-bit data is input to the input terminal 5 of the thermal head 20 as data DA2. The data DA2 is written in the shift register 6.

After the 512-bit data DA2 is written in the shift register 6 in response to a clock CLK2, a latch signal LT2 is applied from the head control circuit 16 to the terminal 3 of the thermal head 20 in step S5, thereby shifting the 512-bit data from the shift register 6 to the latch circuit 7. After the 512-bit data DA2 is input to the shift register 6 in response to the clock CLK2, the latch signal LT2 is applied from the head control circuit 16 to the terminal 3 of the thermal head 20, thereby shifting the 512-bit data from the shift register 6 to the latch circuit 7 and is latched by the latch circuit 7. In step S6, the data latched by the latch circuit 7 is input to one input terminal of each of the AND gates $A_1$ to $A_{512}$ as data DA2. Present printing bit data and a strobe width corresponding to the head temperature are determined by the head control circuit 16 in accordance with a value written in the ROM 17. The determined data as a strobe signal ST2 is supplied to the other input terminal of each of the AND gates $A_1$ to $A_{512}$ through the terminal 2 of the thermal head 20 and the inverter 9, thereby selectively enabling the transistors $T_1$ to $T_{512}$ and hence applying voltages to heat generating members selected from the heat generating members $R_1$ to $R_{512}$ in accordance with a recording image.

The strobe width of the strobe signal applied to the thermal head is wide (thermal transfer recording) enough to transfer one-level ink to a recording sheet or wide (thermal recording) enough to cause color development of a thermal sheet by a one-level density since bit 0 to bit 6 of the head drive data are subjected to printing.

After the voltages are applied to the selected heat generating members, N is decremented in step S7. The system controller 18 determines in step S8 whether N is "0". Since N is not "0" in this case, the flow returns to step S4, and steps S4 to S8 are repeated for bit 1.

The same operations as described above are repeated for bit 2, . . . bit 6 of the thermal drive data.

When processing for bit 6 is completed, the upper 3 bits of the image data are P-S converted in step S9, and N is incremented by one in step S10.

In step S11, the value "1" of bit 7 as the LSB of the 7-bit data is input to the data input terminal 5 of the thermal head 20 as data DA2. The 512-bit data DA2 is input to the shift register 6 in response to the clock CLK2. After the data DA2 is input to the shift register 6, a latch signal LT2 is applied from the head control circuit 16 to the terminal 3 of the thermal head 20 in step S12, thereby shifting the 512-bit data from the shift register 6 to the latch circuit 7. In step S13, the data DA2 latched by the latch circuit 7 is input to one input terminal of each of the AND gates $A_1$ to $A_{512}$ to determine present printing bit data and a strobe width corresponding to the head temperature by the head control circuit 16 in accordance with a value written in the ROM 17. The determined strobe width data is selectively supplied to the other terminal of each of the AND gates $A_1$ to $A_{512}$ through the terminal 2 of the thermal head 20 and the inverter 9. The transistors $T_1$ to $T_{512}$ are selectively turned on to apply voltages to the selected heat generating members.

The strobe width of the strobe signal is determined to be wide enough to cause color development of the ink or thermal sheet by 8 gradation levels since bit 7 to bit 13 of the thermal head drive data are subjected to printing.

After the voltages are applied to the selected heat generating members, the system controller 18 determines in step S14 whether N is "7". If it is NO in step S14, the flow returns to step S10. Steps S10 to S13 are repeated for bit 8 again.

The operations in steps S10 to S14 are repeated for bit 9, . . . bit 13 of the image data. When the operation for bit 13 is completed, printing is shifted to the next line.

Figure 4:
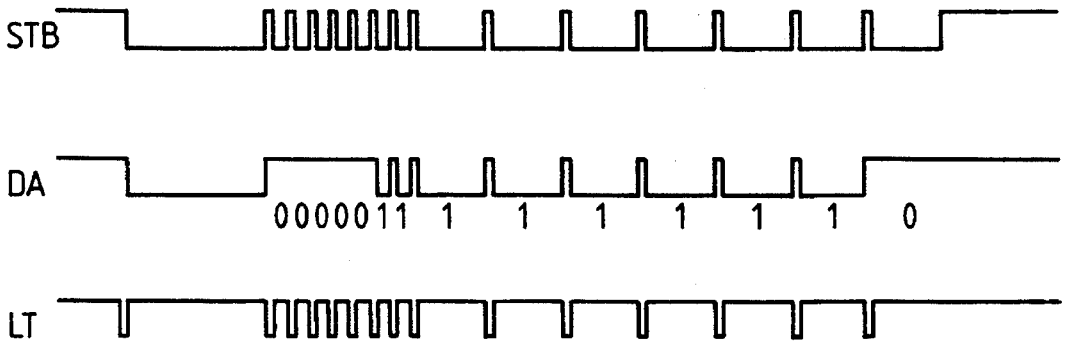
FIG. 4 is a timing chart showing signals applied to the thermal head 20 when printing at a gradation level "50" is to be performed.

In this embodiment, "50" is given as input image data. As shown in the timing chart of FIG. 4, the thermal head 20 is energized during a period corresponding to a continuous bit train of bit 5 to bit 12 of the head drive data. As for bit 5 and bit 6, energy required for color development by one gradation level is supplied to the thermal head. As for bits 7 to 12, energy required for color development by 8 gradation levels is supplied to the thermal head. Therefore, energy required for color development by 50 (=1×2+8×6) gradation levels is continuously supplied to the thermal head 20.

In this embodiment, the 14-bit head drive data corresponding to the 6-bit image data is applied to the thermal head 20 independently of preheating data for increasing the temperature of the thermal head to a temperature required for causing color development of an ink sheet (thermal transfer recording) or thermal sheet (thermal recording). However, the preheating strobe width may be added to printing data, and the resultant data may be used as head drive data. In this case, head drive data are exemplified in Table 2. Table 2 shows a relationship between image data and head drive data when preheating components are added to printing data. A period required for sufficiently preheating the thermal head is 12 times the period required for color development by one gradation level. As can be understood from Table 2, the number of data transfer cycles of the thermal head 20 is increased by two cycles, but perfectly continuous driving including preheating can be performed.

In the above embodiment, the thermal transfer recording and thermal recording methods are exemplified. However, the present invention is not limited to these methods. For example, the present invention is also applicable to an ink-jet recording method in which image is recorded on a recording medium by the discharge of ink.

TABLE 2

| Image Data | Head Drive Data |
|---|---|
| 000000 (0) | 000000001 1111000 |
| 000001 (1) | 000000001 1111100 |
| . | . |
| . | . |
| . | . |
| 111111 (63) | 111111111 1110000 |

Figure 5:
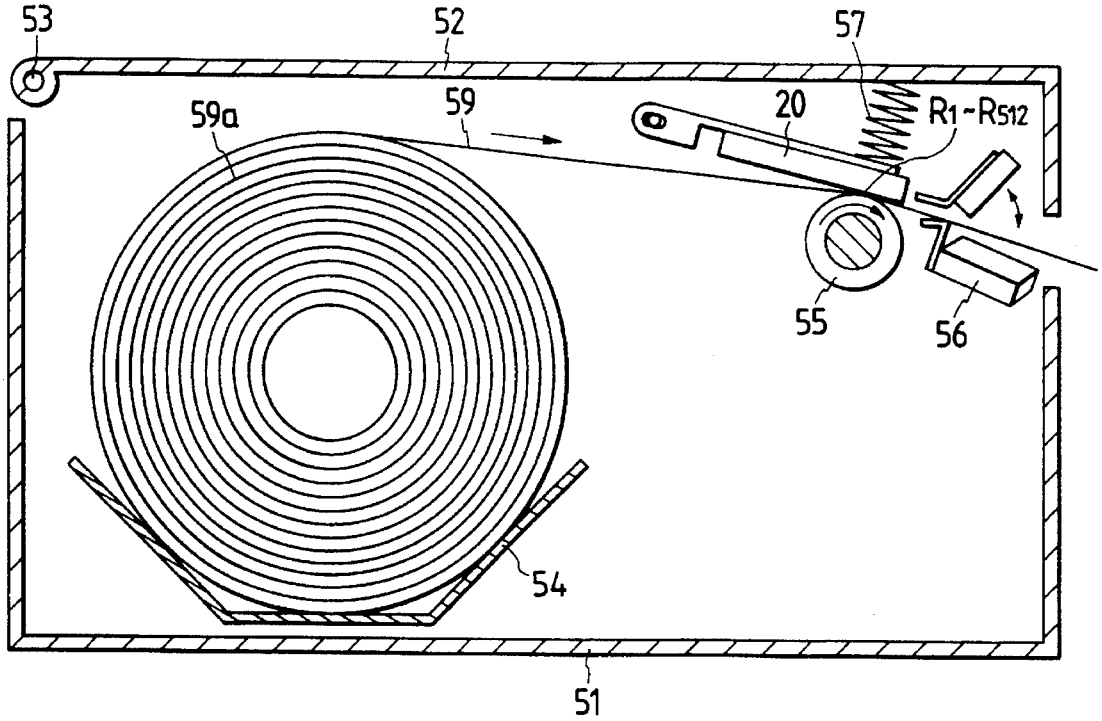
FIG. 5 is a sectional view showing a thermal printer using the thermal recording method of the present invention.

An arrangement of a thermal printer apparatus as the recording apparatus using the thermal recording method described above will be described with reference to FIG. 5.

A housing 51 of the printer apparatus using the thermal recording method incorporates various components to be described later. A cover 52 can be opened/closed pivotally about a shaft 53. A recording sheet holder 54 stores a recording paper roll 59*a* obtained by winding thermal recording paper 59 in the form of a roll. The thermal head 20 has the heat generating members $R_1$ to $R_{512}$ extending along the entire width and is controlled by the thermal recording method described above. A platen roller 55 conveys the recording paper 59. A cutter 56 cuts the recording paper 59 on which an image is recorded by the thermal head 20. A spring 57 biases the thermal head 20 against the platen roller 55 through the recording paper 59.

The recording paper 59 pulled from the roll 59*a* upon clockwise rotation of the platen roller 55 is further conveyed by the platen roller 55. An image is formed by the thermal head 20 controlled by the thermal recording method when the recording paper 59 passes between the platen roller 55 and the thermal head 20. The recording paper 59 on which an image is recorded is cut by the cutter 56, and the cut sheet is exhausted outside the apparatus.

Figure 6:
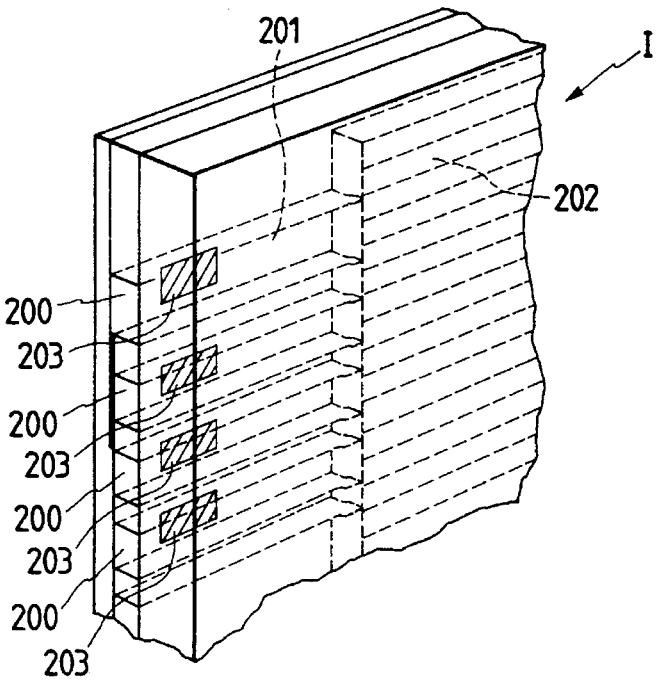
FIG. 6 is a perspective view showing an arrangement of an ink-jet head which can employ the thermal recording method of the present invention.

An ink-jet head as another arrangement of the recording head which employs the present invention will be described below. FIG. 6 is a perspective view of an ink-jet head I from which a recording liquid is discharged.

An orifice 200 serves as an ink discharge port through which the ink solution used as a recording fluid is discharged. A liquid flow path 201 causes the orifice 200 to communicate with a liquid chamber 202. Heaters 203 constitute electric/thermal conversion means which serve as heat generating members. The heaters 203 selectively apply heat energy to the ink in the liquid flow paths 201 to discharge the ink from the discharge ports 200 to form discharge droplets on the basis of the change in state of the ink.

In order to perform recording using the ink-jet head I, an ink solution is supplied from a main tank (not shown) to the liquid chamber 202 and the liquid flow paths 201 through a supply pipe (not shown). The heaters 203 are energized by the same thermal recording method as described with the above embodiment. The heaters 203 are selectively heated, and thermal energies are applied to ink components near the corresponding heaters 203. Bubbles are formed with an instantaneous increase in volume of the ink solution near the corresponding heaters 203. Each ink flow is discharged from the corresponding orifice 200, thus forming a discharge ink droplet. This droplet is transferred to a recording medium such as paper, thereby performing recording. The ink-jet head I may be used in place of the thermal head 20 shown in FIG. 5 to appropriately employ the above-mentioned arrangement to constitute an ink-jet printer.

As has been described above, according to the present invention, there is provided a thermal recording method capable of obtaining a clear image and a recording apparatus using this thermal recording method.

What is claimed is:

1. A recording method for recording at a desired image density by controlling energization of a recording element of a recording head in accordance with a gradation of a recording image, said method comprising the steps of:

dividing image data having a plurality of arrays of bits exhibiting the gradation into a first array of bits and a second array of bits, both said first array of bits and said second array of bits having continuous bits in said plurality of arrays of bits;

converting said first array of bits to a first array of drive data;

converting said second array of bits into a second array of drive data, said first array of drive data and said second array of drive data each having a plurality of bits indicating a number of energization of the recording element of said recording head, said first array of drive data and said second array of drive data being arrays of serial data continuing from a lower bit to an upper bit;

a first driving step of driving said recording head sequentially from the lower bit to the upper bit of said first array of drive data with a pulse having a first pulse width corresponding to said first array of drive data; and a second driving step of driving said recording head sequentially from the lower bit to the upper bit of said second array of drive data with a pulse having a second pulse width corresponding to said second array of drive data.

2. A recording method according to claim 1, wherein an energization time of said recording element is different in said first and said second driving steps.

3. A method according to claim 1, wherein said recording head includes a thermal head having a plurality of heat generating members.

4. A method according to claim 1, wherein said recording head includes an ink-jet head having a plurality of discharge ports for discharging an ink solution.

5. A method according to claim 1, wherein said recording head includes an ink jet head for forming a bubble in an ink solution upon heating of a heat generating element and discharging the ink solution from a discharge port upon a state change of the ink solution.

6. A recording method according to claim 1, wherein said first array of bits is a lower bit array of said image data.

7. A recording method according to claim 1, wherein said first array of drive data comprises a plurality of bit arrays greater than said lower bit array.

8. A recording method according to claim 1, wherein said second array of drive data comprises a plurality of bit arrays greater than said upper bit array.

9. A method according to claim 1, wherein said first array of drive data and said second array of drive data are obtained by parallel-serial converting said first array of bits and said second array of bits.

10. A method according to claim 1, further comprising the step of applying a pulse to increase the temperature of the recording element of said recording head to a predetermined temperature before commencement of recording.

11. A recording method for recording at a desired image density by controlling energization of a recording element of a recording head in accordance with a gradation of a recording image, said method comprising the steps of:

dividing image data having a plurality of arrays of bits exhibiting the gradation into a first array of bits and a second array of bits, both of said first array of bits and said second array of bits having continuous bits in said plurality of arrays of bits;

converting said first array of bits to a first array of drive data;

converting said second array of bits into a second array of drive data, said first array of drive data and said second array of drive data each having a plurality of bits indicating a number of energization of the recording element of said recording head, said first array of drive data and said second array of drive data being arrays of serial data continuing from a lower bit to an upper bit;

a first driving step of driving said recording head sequentially from the lower bit to the upper bit of said first array of drive data by a driving pulse responsive to a temperature of said recording head and having a first pulse width corresponding to said first array of drive data; and a second driving step of driving said recording head sequentially from the lower bit to the upper bit of said second array of drive data by a driving pulse responsive to the temperature of said recording head and having a second pulse width corresponding to said second array of drive data.

12. A recording method according to claim 11, wherein an energization time of said recording element is different in said first and said second driving steps.

13. A method according to claim 11, wherein said recording head includes a thermal head having a plurality of heat generating members.

14. A method according to claim 11, wherein said recording head includes an ink-jet head having a plurality of discharge ports for discharging an ink solution.

15. A method according to claim 11, wherein said recording head includes an ink jet head for forming a bubble in an ink solution upon heating of a heat generating element and discharging the ink solution from a discharge port upon a state change of the ink solution.

16. A recording method according to claim 11, wherein said first array of bits is a lower bit array of said image data.

17. A method according to claim 11, wherein said first array of drive data and said second array of drive data are obtained by parallel-serial converting said first array of bits and said second array of bits.

18. A method according to claim 11, further comprising the step of applying a pulse to increase the temperature of the recording element of said recording head to a predetermined temperature before commencement of recording.

19. A recording apparatus for recording at a desired image density by controlling energization of a recording element of a recording head in accordance with a gradation of a recording image, said apparatus comprising:

input means for inputting image data having a plurality of arrays of bits exhibiting the gradation;

head driving data forming means for forming head driving data by dividing the image data into a first array of bits and a second array of bits having continuous bits in said plurality of arrays of bits, converting said first array of bits to a first array of drive data and converting said second array of bits to a second array of drive data, wherein said first array of drive data and said second array of drive data each have a plurality of bits indicating a drive of the recording element of the recording head, and said first array and said second array are arrays of serial data continuing from a lower bit to an upper bit; and head driving means for driving said recording head sequentially from the lower bit to the upper bit of said first array of drive data with a pulse width corresponding to said first array of drive data and, after driving said recording head in accordance with said first array of drive data, driving said recording head sequentially from the lower bit to the upper bit of said second array of drive data with a pulse width corresponding to said second array of drive data.

20. A recording apparatus according to claim 19, wherein an energization time of said recording element is different in said driving in accordance with said first array of drive data and driving in accordance with said second array of drive data.

21. An apparatus according to claim 19, wherein said recording head includes a thermal head having a plurality of heat generating members.

22. An apparatus according to claim 19, wherein said recording head includes an ink-jet head having a plurality of discharge ports for discharging an ink solution.

23. An apparatus according to claim 19, wherein said recording head includes an ink jet head for forming a bubble in an ink solution upon heating of a heat generating element and discharging the ink solution from a discharge port upon a state change of the ink solution.

24. A recording apparatus according to claim 19, further comprising head temperature detecting means for detecting a temperature of said recording head.

25. A recording apparatus according to claim 24, wherein said head driving means changes an energization time of said recording element of said recording head in accordance with detection results of said head temperature detecting means.

26. A recording apparatus according to claim 24, wherein said head driving data forming means forms said head driving data by adding data for energizing said recording element in response to detection results of said head temperature detecting means to said first array of drive data and said second array of drive data.

27. A recording apparatus according to claim 26, wherein said recording element is a heat generating element for generating heat upon energization of said recording element and preheating for said heat generating element is performed according to said data for energizing said recording element in response to detection results of said head temperature detecting means which is added to said first array of drive data and said second array of drive data.

28. A recording apparatus according to claim 19, wherein said first array of bits is a lower bit array of said image data.

29. An apparatus according to claim 19, wherein said first array of drive data and said second array of drive data are obtained by parallel-serial converting said first array of bits and said second array of bits.

30. An apparatus according to claim 19, further comprising the step of applying a pulse to increase the temperature of the recording element of said recording head to a predetermined temperature before commencement of recording.

31. A recording method of recording an image on a recording medium at a desired density by continuously energizing a heat generating element of a recording head in response to a number of gradations of said image, comprising the steps of:

dividing an image data in which said gradations are expressed by a plurality of bits of said image data for driving a recording head, and said plurality of bits is divided into a first group having a plurality of said bits and a second group having a plurality of said bits and terminating a continuous application of energy to said recording head in accordance with said first group coincident with commencing a continuous application of energy to said recording head in accordance with said second group so that energy is continuously applied to said recording head and then converting said image data to obtain a driving data for said recording head, said driving data including a first array and a second array each having a plurality of bits indicating a drive of the heat generating element of the recording head, said first array and said second array being arrays of serial data continuing from a lower bit to an upper bit; and controlling a pulse width of a strobe signal corresponding to each bit of the converted driving data and a value of serial data applied to said recording head, thereby performing halftone image recording.

32. A method according to claim 31, wherein said first array of drive data and said second array of drive data are obtained by parallel-serial converting said first array of bits and said second array of bits.

33. A method according to claim 31, further comprising the step of applying a pulse to increase the temperature of the recording element of said recording head to a predetermined temperature before commencement of recording.

* * * * *